US005243157A

United States Patent [19]

Hoffman

[11] Patent Number: 5,243,157

[45] Date of Patent: Sep. 7, 1993

[54] LOCKABLE HANDLE

[75] Inventor: Ernest G. Hoffman, Middlefield, Conn.

[73] Assignee: Hubbell Incorporated, Orange, Conn.

[21] Appl. No.: 879,831

[22] Filed: May 6, 1992

[51] Int. Cl.[5] ..... H01H 9/22

[52] U.S. Cl. ..... 200/43.11; 200/43.19

[58] Field of Search ..... 200/43.14, 43.11, 43.19, 200/43.21, 336

[56] References Cited

U.S. PATENT DOCUMENTS

| | | | |
|---|---|---|---|
| 1,321,645 | 11/1919 | Klein | 200/43.14 |
| 1,383,330 | 7/1921 | Naul | 200/43.11 |
| 2,313,170 | 3/1943 | Pierce | 200/43.14 |
| 3,296,391 | 1/1967 | Zavertnik et al. | 200/43.14 |

*Primary Examiner*—Renee S. Luebke

*Attorney, Agent, or Firm*—Jerry M. Presson; Walter C. Farley

[57] ABSTRACT

A housing contains a device such as an electrical switch and a handle is mounted on a cover of the housing. The handle is rotatable between first and second positions. The handle is coupled to the device within the housing so that when the handle rotates, the device is changed from one state to another. An annular wall partially surrounds the handle, the wall having end faces which limit the rotational movement of the handle. The wall and the handle have holes which can be aligned in one position of the handle and held in that position by inserting the shackle of a lock. With this structure, a switch can be locked in an off or on position to inhibit unauthorized changing of the switch position.

8 Claims, 3 Drawing Sheets

LOCKABLE HANDLE

FIELD OF THE INVENTION

This invention relates to a lockable handle for an electrical device wherein the handle acts as an operator for a device within a housing and wherein the handle can be locked in a predetermined position.

BACKGROUND OF THE INVENTION

There are certain types of applications for switches and other electrical devices, as well as mechanical devices such as hydraulic valves, in which the switch or other device is enclosed within a housing and is operated by a movable handle or lever from outside of the housing. The device within the housing may be connected to a motor or other electrical load and it is commonly important, for safety and other reasons, to be sure that the switch is not operated inadvertently or by a person who does not understand why it is in the position which it occupies.

For this reason, switch actuators are sometimes provided with a locking capability which permits the switch to be locked in one or more of its operative positions, typically either on or off.

SUMMARY OF THE INVENTION

An object of the present invention is to provide a lockable actuator for a switch or the like contained within a housing which can be arranged to be locked in one operative position or in any of two or more operative positions.

A further object is to provide such a device which is simple to manufacture and assemble and which presents a pleasing appearance.

Briefly described, the invention comprises a lockable handle for an electrical device housing containing an electrical device wherein the housing has a cover with an outer surface. An annular wall is attached to the outer surface. A handle including a cylindrical portion within the annular wall has a manually movable portion. The handle is mounted for rotary movement between first and second positions. The annular wall has an opening therethrough and the handle also has an opening, the two openings being alignable in one of the two positions. The shackle of a lock is insertable through the aligned openings to inhibit movement of the handle away from the position in which the openings are aligned. The handle is coupled to the electrical device within the housing for operating the device when the handle is rotated from one position to the other.

BRIEF DESCRIPTION OF THE DRAWINGS

In order to impart full understanding of the manner in which these and other objects are attained in accordance with the invention, particularly advantageous embodiments thereof will be described with reference to the accompanying drawings, which form a part of this disclosure. In the following descriptions, the term "inner" will be used to mean in the direction toward the interior of the housing, generally toward the electrical device within the housing, and "outer" will mean away from the electrical device. In the drawings.

DESCRIPTION OF THE PREFERRED EMBODIMENTS

Figure 1:
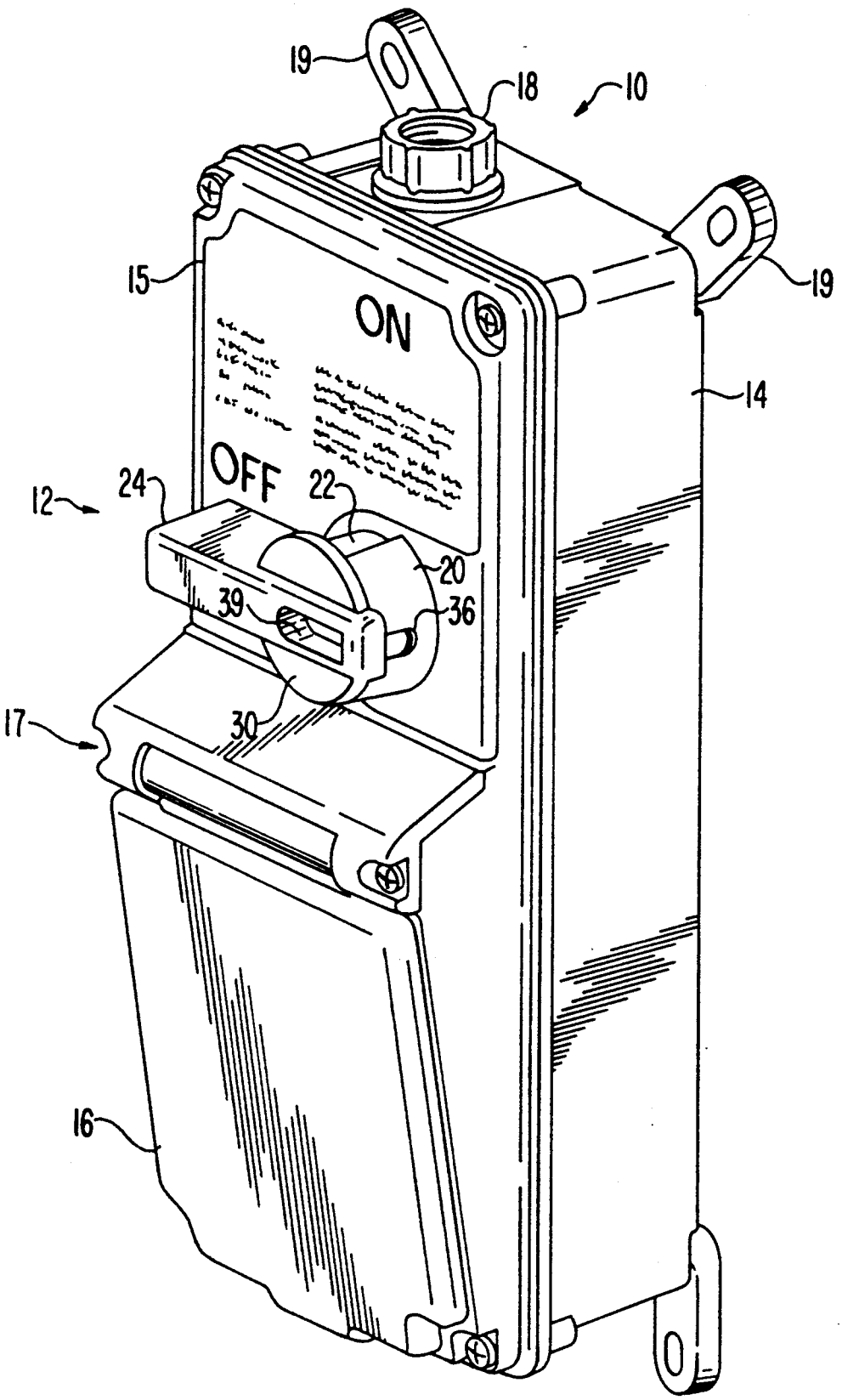
FIG. 1 is a perspective view of an electrical device housing having a handle structure in accordance with the present invention.

To establish the context of the present invention, FIG. 1 shows an enclosure indicated generally at 10 of a type which is intended to contain an electrical switch, not visible in FIG. 1, which is enclosed within the housing and operated by a handle structure indicated generally at 12. The housing includes a generally rectangular enclosure 14 and a cover 15 which is attached to enclosure 14 by screws. Cover 15 has an outer surface, visible in FIG. 1, to which the handle structure is attached, a portion of the handle structure extending through the cover as will be described.

The housing of FIG. 1 also includes a lid 16 which is hinged, as generally indicated at 17, and can be opened to reveal an electrical receptacle by which the switch within the housing can be connected to a motor or other device. The particular type of connection, however, is not important to the present invention because the handle and switch arrangements are capable of wide and varied application.

The housing is also typically provided with means 18 for connection to a conduit by which the devices within the housing can be permanently wired to a source of power, and with mounting feet 19 to permit the housing to be attached to a wall or the like.

Figure 2:
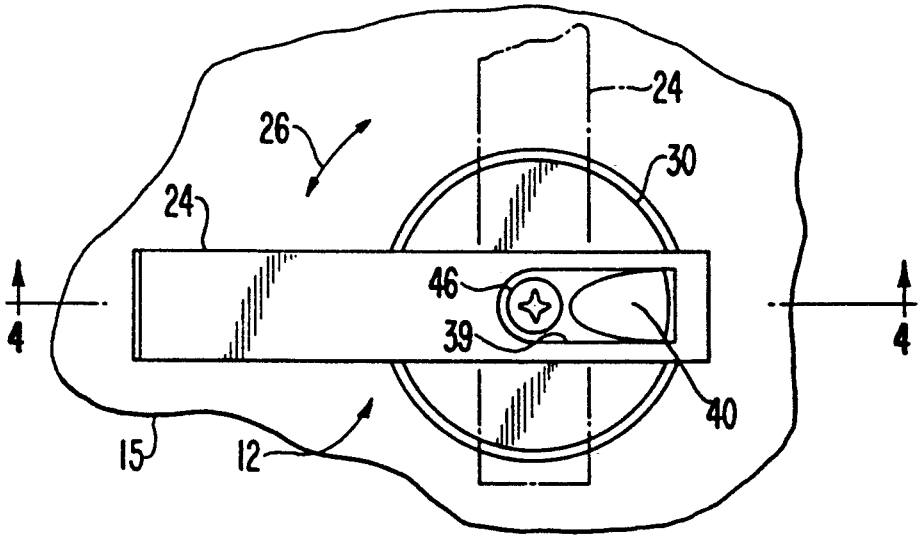
FIG. 2 is a front elevation of a handle structure in accordance with the present invention.
Figure 3:
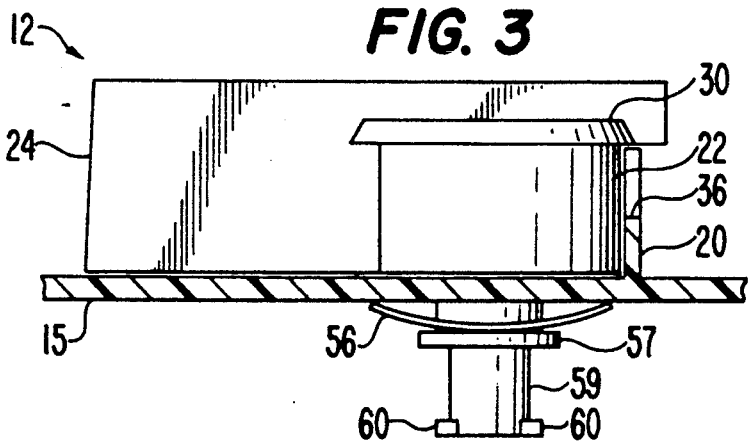
FIG. 3 is a bottom plan view, in partial section, of the handle structure of FIG. 2.
Figure 4:
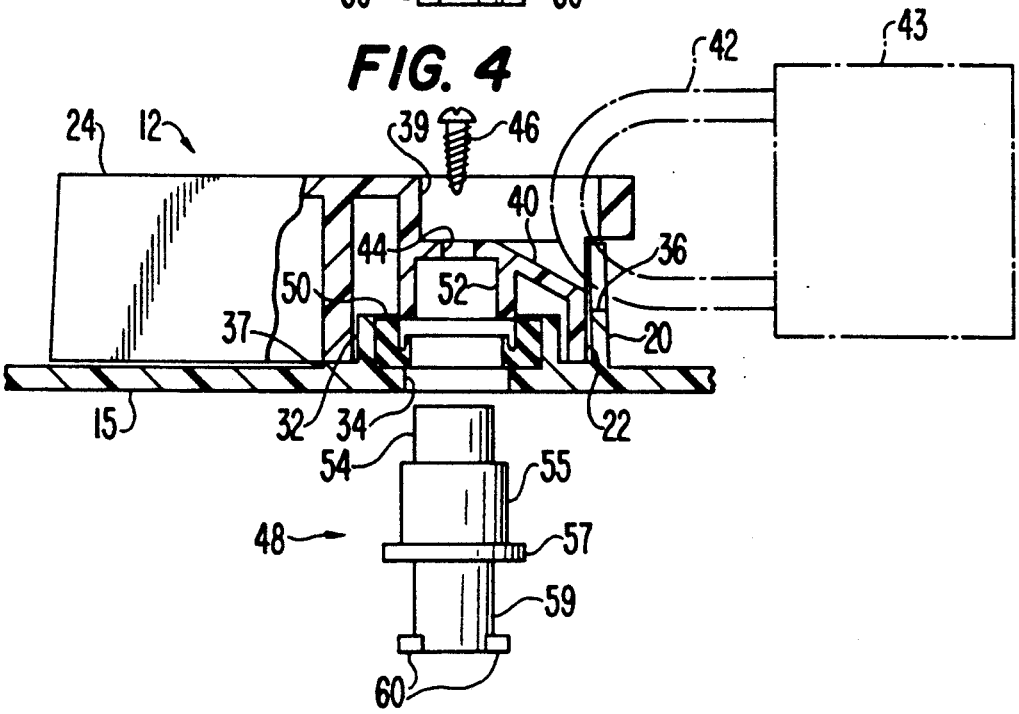
FIG. 4 is a partially exploded bottom plan view in partial section along line 4—4 of FIG. 2.

FIGS. 2–4 show in somewhat greater detail the handle structure which is the subject of the present invention. The visible portions of the lockable handle structure include a generally annular wall 20 and the handle itself which includes a cylindrical portion 22 and a manually movable portion 24 which can be grasped and moved from one position to another as indicated by the double-headed arrow 26 in FIG. 2. FIG. 2 shows the switch in solid lines in the "off" position illustrated in FIG. 1 and, in dot-dash lines, in the "on" position.

Figure 5:
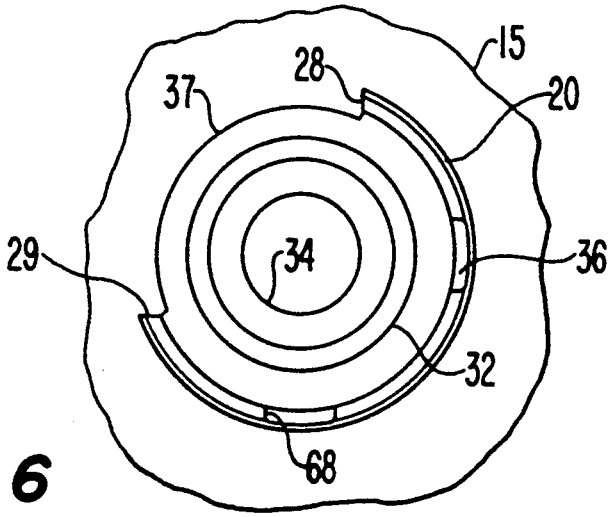
FIG. 5 is a front elevation of an annular wall and circular guide portion of the handle structure.
Figure 6:
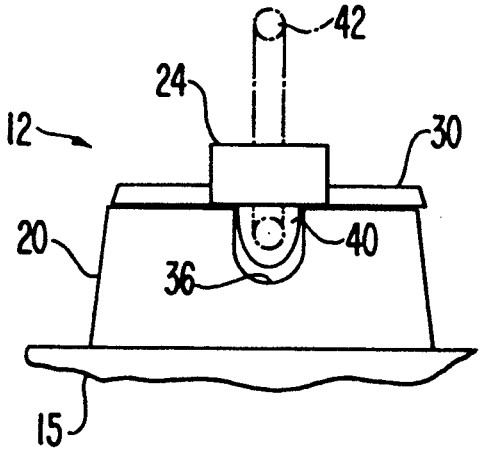
FIG. 6 is a right side elevation of the handle structure of FIGS. 2–4.

As seen in FIGS. 1 and 5, annular wall 20 is interrupted to provide a passageway for manually graspable portion 24 of the handle. End faces 28 and 29 at the ends of the wall act as stops to limit the rotary motion of handle portion 24 in the on and off positions, respectively. Thus, wall 20 occupies somewhat less than 270° of arc.

As seen in FIG. 3, cylindrical portion 22 is joined to portion 24 and has, at its upper end, a circular disk 30 the rim of which substantially covers the distal edge of wall 20.

FIG. 5 illustrates those components which are formed on, and are a part of, cover 15. Preferably, the cover and these associated components are unitarily molded as a single piece. In addition to wall 20, an annular boss 32 protrudes from the front surface of cover 15 and is concentric with wall 20. A hole 34 passes through cover 15 to provide for passage of a coupling element which interconnects the handle structure with the switch or other device within the housing. A generally U-shaped indentation 36 is formed in wall 20 to provide a lock passage therethrough. A slightly raised portion 37 is formed around the outside of boss 32 and within wall 20 to act as a washer, slightly spacing the handle structure from the front surface of cover 15 so that the handle can rotate freely without frictional engagement with the cover.

The sectional view of FIG. 4 shows the interior structure of the handle and the manner in which a lock can be applied. The handle is formed with an opening 39 which extends downwardly into cylindrical portion 22, the lower surface of the opening having a curved, sloping surface 40 which is alignable with opening 36 through wall 20. When these openings are aligned, the shackle 42 of a lock 43 can be passed through the openings and locked, preventing movement of the handle from the aligned position. At the bottom of opening 39 is a hole 44 through which a screw 46 can be passed to threadedly engage a central hole in the outer end of a coupling stem indicated generally at 48. Within boss 32 is a rubber gasket 50 which surrounds the coupling stem and inhibits entry of moisture into the housing.

The interior of the cylindrical portion is formed with a socket 52 which is non-circular and which is shaped and dimensioned to matingly receive a non-circular stud 54 at the outer end of stem 48. Adjacent stud 54 of the stem is a circular cylindrical portion 55 dimensioned to be slidably received in opening 34 and to be rotatable therein. A rectangular leaf spring 56 is positioned between the inner surface of cover 15 and a flange 57 at the inner extremity of cylindrical portion 55 to urge the coupling stem inwardly against the restraining force of screw 52. Finally, at the inner extremity of stem 48 is a smaller cylindrical stud portion 59 having at the distal end thereof an arrangement of lobes 60 arranged to matingly engage the switch itself.

Figure 7:
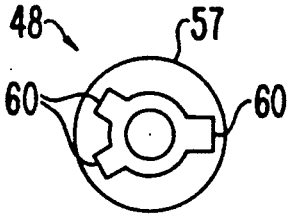
FIG. 7 is an interior elevation of a coupling element usable with the handle structure of FIGS. 2–4.
Figure 8:
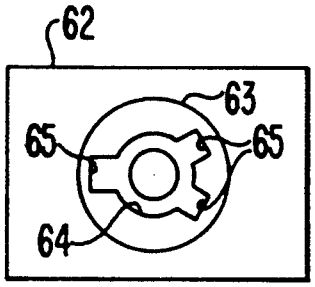
FIG. 8 is a front elevation of a switch operator usable with the handle of the present invention.

FIG. 7 shows an end view of stud 59 at the inner end of coupling stem 48 with its arrangement of lobes 60 non-uniformly circularly distributed so that it provides a unique non-symmetrical shape. FIG. 8 is a simplified front view of a switch housing of a type which can be contained within enclosure 14. Switch 62 has a rotatable switch operator portion 63 having a central recess 64 with a plurality of lateral recesses 65 extending radially outwardly therefrom in the same arrangement as lobes 60 on stud 59. As will be seen from a comparison of FIG. 7 and 8, if the stem of FIG. 7 is inverted, the arrangement of lobes will fit in the recesses of FIG. 8 somewhat like a key in a lock, the two having a specific, unique relative orientation.

Figure 9:
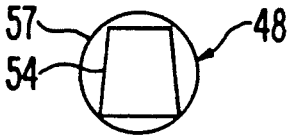
FIG. 9 is an outer end elevation of the coupling element of FIG. 7.

FIG. 9 shows the other end of stem 48 with non-circular stud 54 which is in the shape of a trapezoid. Socket 52 is formed with a mating shape so that the handle and the outer end of stud 48 also have a single, unique relative orientation in which they fit together.

Thus, with these specific non-circular relationships, when stem 48 joins handle 12 to switch 62, there is only one possible orientation between the handle and the switch. This guarantees that when the handle is in the off position, the switch operator is also necessarily in the off position.

From the foregoing, it will be recognized that the handle 12 can be placed in the off position and the lock can be inserted with its shackle through openings 39 and 36 in the handle and annular wall, respectively, such that the handle cannot be rotated to the "on" position without first removing the lock. Any of a wide variety of locking devices can, of course, be used, a conventional padlock being illustrated as perhaps the most common device for this purpose.

There are circumstances under which it may be desirable to lock the switch in the "on" position rather than the "off" position. For this purpose, a second recess 68 can be formed in annular wall 20 so that opening 39 through handle 24 can be aligned with opening 68 to receive the shackle 42 of the lock. The invention also contemplates the possibility of providing additional openings in wall 20 for use, for example, with a multiple position switch when there is a need to lock the switch in any of the possible positions. The number of openings is limited only by the physical size and strength characteristics of the wall and handle structure.

While certain advantageous embodiments have been chosen to illustrate the invention, it will be understood by those skilled in the art that various changes and modifications can be made therein without departing from the scope of the invention as defined in the appended claims.

What is claimed is:

1. A lockable handle and housing assembly for containing a switchable device, said housing having a cover with an outer surface, the assembly comprising the combination of an annular wall attached to said outer surface;

a handle comprising a generally cylindrical portion within and partially surrounded by said annular wall and a manually graspable portion;

means for mounting said handle for rotary movement between first and second positions;

means in said wall defining a first opening therethrough;

means in said handle defining an elongated second opening therethrough with the direction of elongation being aligned with said manually graspable portion, said second opening being alignable with said first opening in one of said first and second positions and having a sloping guide portion leading to said first opening;

a lock having a shackle insertable through said aligned first and second openings to inhibit movement of said handle away from the position in which said openings are aligned; and means for coupling said handle to said switchable device within said housing for operating said device when said handle is rotated from one position to the other.

2. An assembly according to claim 1 wherein said annular wall includes means defining first and second end faces defining an interruption in said wall so that said wall surrounds less than 270° of said cylindrical portion of said handle, and wherein said manually graspable portion extends through said interruption, said end faces forming stops to limit the rotary movement of said handle.

3. An assembly according to claim 2 wherein said device is an electrical switch having a rotatable switch operator movable between two positions for changing said switch between "off" and "on" conditions, said two positions of said switch corresponding to said first and second positions of said handle.

4. An assembly according to claim 1 wherein said means for coupling said handle to said device comprises an elongated non-circular stem having a central axis, means at one end of said stem for attaching said stem to said handle for rotation about said central axis with said handle and means at the other end of said stem for coupling the other end of said stem to said device so that rotation of said stem operates said device.

5. An assembly according to claim 4 and including means in said wall defining a plurality of openings through said wall, said shackle of said lock being insertable through said second opening in said handle and any one of said plurality of openings in said wall to inhibit movement of said handle away from the position in which said openings are aligned.

6. An assembly according to claim 5 and including means surrounding said stem for resisting entry of moisture into said housing.

7. A lockable operator assembly for an electrical device in a housing having a cover with an outer surface, the operator comprising the combination of an interrupted annular wall attached to said outer surface;

a handle comprising a generally cylindrical portion within and partially surrounded by said annular wall and a manually graspable portion, said handle being rotatable between first and second positions;

means in said wall defining a first opening therethrough;

means in said handle defining an elongated second opening therethrough with the direction of elongation being aligned with said manually graspable portion, said second opening being alignable with said first opening in one of said first and second positions;

means insertable through said aligned first and second openings for inhibiting movement of said handle away from the position in which said first and second openings are aligned, said second opening further including a sloping guide surface for guiding said insertable means to and through said openings; and means for coupling said handle to the electrical device within said housing for operating said device when said handle is rotated from one position to the other.

8. A lockable operator assembly for an electrical device in a housing having a cover with an outer surface, the operator comprising the combination of an interrupted annular wall attached to said outer surface;

a handle comprising a generally cylindrical portion within and partially surrounded by said annular wall and a manually graspable portion, said handle being rotatable between first and second positions;

means in said wall defining a first opening therethrough;

means in said handle defining an elongated second opening therethrough with the direction of elongation being aligned with said manually graspable portion, said second opening being alignable with said first opening in one of said first and second positions;

a sloping guide surface for guiding an insertable member to and through said first and second openings for inhibiting movement of said handle away from the position in which said first and second openings are aligned; and means for coupling said handle to the electrical device within said housing for operating said device when said handle is rotated from one position to the other.

* * * * *